US008333102B2

(12) United States Patent
Van Opynen et al.

(10) Patent No.: US 8,333,102 B2
(45) Date of Patent: Dec. 18, 2012

(54) EXTENSION FOR A PIPE EXPANDER

(76) Inventors: Adam Van Opynen, Windsor Downs (AU); Lambert Van Opynen, Windsor Downs (AU)

( * ) Notice: Subject to any disclaimer, the term of this patent is extended or adjusted under 35 U.S.C. 154(b) by 145 days.

(21) Appl. No.: 12/665,937

(22) PCT Filed: Jun. 20, 2008

(86) PCT No.: PCT/AU2008/000900

§ 371 (c)(1),
(2), (4) Date: Mar. 4, 2010

(87) PCT Pub. No.: WO2009/000020

PCT Pub. Date: Dec. 31, 2008

(65) Prior Publication Data

US 2010/0180660 A1 Jul. 22, 2010

(30) Foreign Application Priority Data

Jun. 22, 2007 (AU) ..... 2007903382

(51) Int. Cl.
*B21D 39/08* (2006.01)
*B21D 41/02* (2006.01)

(52) U.S. Cl. ..... 72/453.15; 72/370.06; 72/393; 72/453.16; 29/237

(58) Field of Classification Search ..... 72/316, 72/370.06, 393, 453.16, 453.17, 453.15; 29/237

See application file for complete search history.

(56) References Cited

U.S. PATENT DOCUMENTS

| | | | | |
|---|---|---|---|---|
| 3,087,530 | A * | 4/1963 | Frank, Jr. et al. | 72/453.16 |
| 3,722,064 | A * | 3/1973 | Spontelli | 29/237 |
| 4,198,844 | A * | 4/1980 | Lowe et al. | 72/393 |
| 4,212,183 | A | 7/1980 | Mabery | |
| 4,475,373 | A | 10/1984 | Ikenberry | |
| 4,494,398 | A * | 1/1985 | Svoboda | 72/393 |
| 6,619,099 | B2 * | 9/2003 | Barjesteh | 72/393 |
| 6,834,524 | B2 * | 12/2004 | Johnston | 72/316 |
| 7,032,429 | B1 * | 4/2006 | McDougle | 72/453.15 |
| 2007/0205072 | A1 | 9/2007 | Villata et al. | |
| 2010/0180660 | A1 * | 7/2010 | Van Opynen et al. | 72/370.06 |

FOREIGN PATENT DOCUMENTS

| | | | |
|---|---|---|---|
| BE | 838674 | A | 5/1976 |
| GB | 2392860 | A | 3/2004 |
| JP | 60001404 | A | 1/1985 |

OTHER PUBLICATIONS

International Search Report PCT/AU2008/000900.
Examination Report for corresponding New Zealand Appln. No. 582603.

* cited by examiner

*Primary Examiner* — David B Jones
(74) *Attorney, Agent, or Firm* — Edwards Wildman Palmer LLP; Howard M. Gitten

(57) ABSTRACT

An assembly for actuating a pipe expander, the assembly comprising a first actuator, arranged to engage a pipe expander head and actuate the same a second actuator, spaced apart from the first actuator and operatively engaged therewith such that operation of the second actuator effects operation of the first actuator to actuate the pipe expander head.

13 Claims, 4 Drawing Sheets

EXTENSION FOR A PIPE EXPANDER

CROSS REFERENCES TO RELATED APPLICATIONS

This application is a U.S. national phase pursuant to 35 U.S.C. §371, of PCT/AU2008/000900, filed Jun. 20, 2008, which claims priority to Australian Patent Application No. 2007903382 filed Jun. 22, 2007. The entire contents of the aforementioned patent applications are incorporated herein by this reference.

BACKGROUND OF THE INVENTION

This invention relates to pipe expanders. When joining lengths of pipe, a tool known as a pipe expander is utilised to enlarge the diameter of the ends of one of the pipes to be joined. The pipe expander takes the form of a main body portion and a number of interchangeable expander heads to suit pipes of various diameters. The main body portion includes two large handles which are squeezed together to effect movement of an internal mechanism which in turn acts to cause movement of the expander head which is screw fitted to the main body portion. The expander head is tapered. Upon insertion into a pipe, the expander head is pushed inward along the pipe by mechanical means such as a shaft. This moves the expander head into the end of the pipe to be expanded. The tapered shape of the expander head means the pipe is forced outwardly in the axial direction. The steel or other pipe is thus expanded.

When working in confined areas, such as near to a wall or floor or on a building site, it is sometimes difficult, or impossible, to gain access to the pipe in order to bring the expander head into engagement with the pipe end to be enlarged.

SUMMARY OF THE INVENTION

In a first aspect, disclosed is an assembly for actuating a pipe expander, the assembly comprising a first actuator, arranged to engage a pipe expander head and actuate the same; and a second actuator, spaced apart from the first actuator and operatively engaged therewith such that operation of the second actuator effects operation of the first actuator to actuate the pipe expander head.

In one form the first actuator and second actuator are connected by a conduit. In one form the first actuator and second actuator are connected by a fluid tight conduit. In one form the fluid tight conduit is flexible.

In one form the first actuator comprises a first piston located within a first cylinder and adapted such that a movement of the first piston with respect to the first cylinder actuates the pipe expander head.

In one form the second actuator comprises a second piston located within a second cylinder.

In one form the first actuator comprises a first piston located within a first cylinder and adapted such that a movement of the first piston with respect to the first cylinder actuates the pipe expander head and the second actuator comprises a second piston located within a second cylinder and wherein the first actuator and second actuator are operatively engaged such that movement of the second piston with respect to the second cylinder effects movement of the first piston with respect to the first cylinder.

In one form the second actuator is adapted to operatively engage with a pipe expander body such that actuation of the pipe expander causes movement of the second piston with respect to the second cylinder.

In one form the first piston is moveable between a retracted position in which it is contained in the cylinder and an extended position in which is extends beyond the cylinder. In one form the first piston actuates the pipe expander head when in the extended position.

It can be seen that use of the assembly to actuate a pipe expander allows a user to expand a pipe which is in a difficult position while remaining some distance from the pipe. This allows for use of a pipe expander in difficult spaces with limited access without requiring significant damage to the structures in which the pipes are positioned.

In a second aspect, disclosed is an extension for a pipe expander, the extension including a first actuator arranged to receive a pipe expander head, the first actuator including a first chamber and piston; a second actuator arranged to fit to a pipe expander, the second actuator including a second chamber and piston; and a fluid tight conduit which joins the first and second chambers.

In one form the conduit is flexible.

In a third aspect, disclosed is a method of using a pipe expander comprising engaging the pipe expander head with a first piston and cylinder assembly such that movement of the first piston with respect to the first cylinder actuates the pipe expander head and initiating movement of the first piston with respect to the first cylinder.

In one form the step of initiating movement of the first piston with respect to the first cylinder comprises initiating movement of a second piston with respect to a second cylinder, the second piston and second cylinder being part of a second piston and cylinder assembly which is in fluid communication with the first piston and cylinder assembly.

In one form the step of initiating movement of the second piston with respect to the second cylinder comprises engaging the second piston and cylinder assembly with a pipe expander such that actuation of the pipe expander causes movement of the second piston with respect to the second cylinder; and actuating the pipe expander.

BRIEF DESCRIPTION OF THE DRAWINGS

An embodiment of the present invention will now be described, by way of example only with reference to the accompanying drawings, in which.

DETAILED DESCRIPTION OF THE PREFERRED EMBODIMENT

Figure 1:
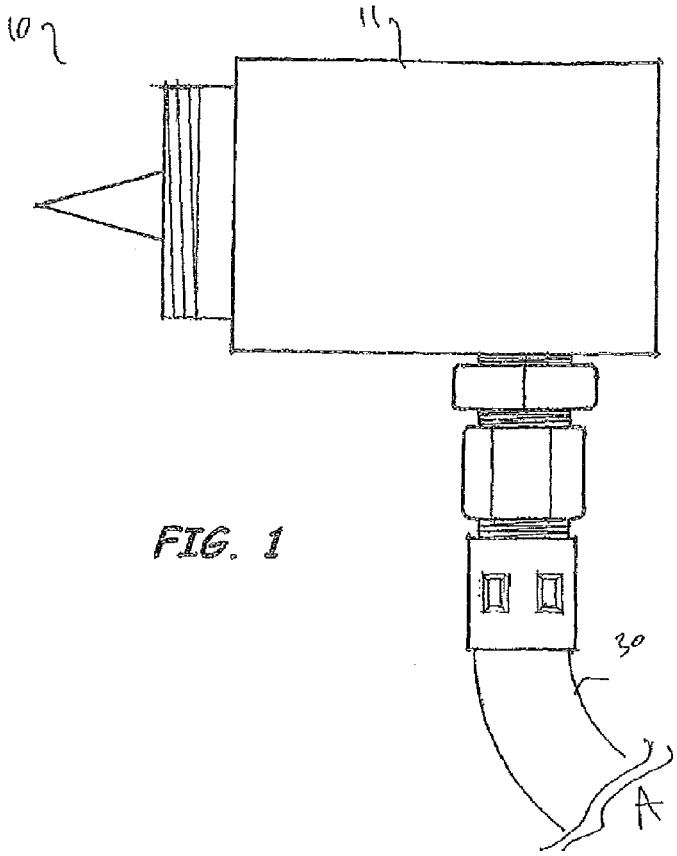
FIG. 1 is a side view of the first actuator of an extension for a pipe expander according to one embodiment of the invention.
Figure 2:
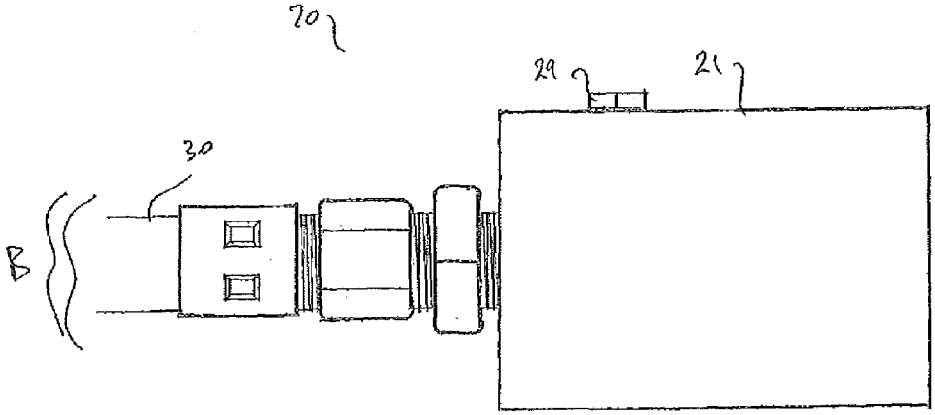
FIG. 2 is a side view of the second actuator of an extension for a pipe expander for use with the first actuator shown in FIG. 1.

Referring to the Figures, disclosed is an assembly 1 for actuating a pipe expander (not illustrated). The assembly 1 includes a first actuator 10 and a second actuator 20 which are operatively engaged.

The first actuator 10 comprises a housing 11 which defines an internal chamber 12. A piston 13 is positioned within internal chamber 12 and is moveable within internal chamber 12 with respect to the housing. The piston 13 is sealed within internal chamber 12 by O rings 14. Thus internal chamber 12 is closed at one end by the piston 13 and O-rings 14.

The piston 13 includes a shuttle pin 17 which extends from the piston 13 in the direction of forward movement of the piston 13 within the housing 11. The shuttle pin 17 extends through an opening 19 in housing 11.

Figure 3:
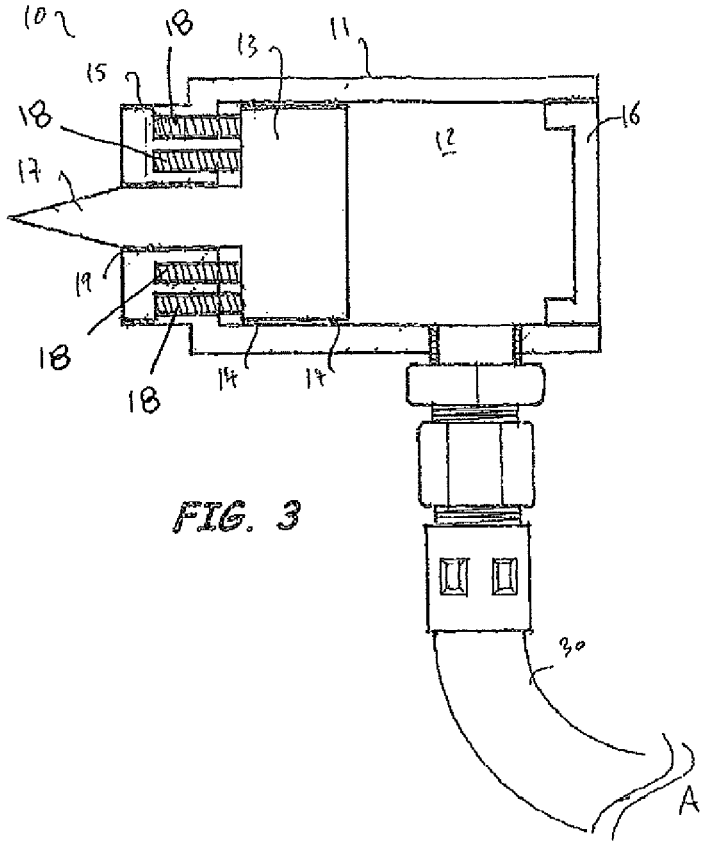
FIG. 3 is a cross sectional view of the actuator of FIG. 1 in an intermediate retracted position.
Figure 5:
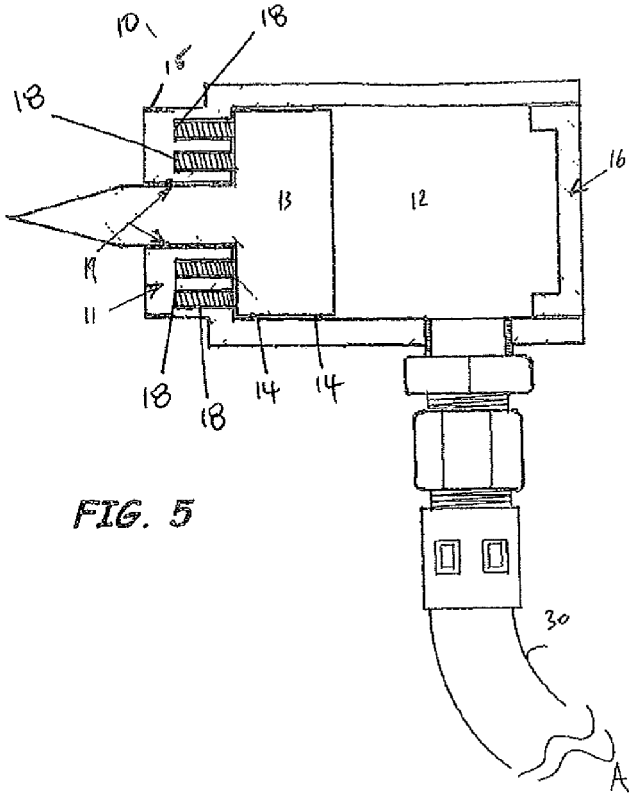
FIG. 5 is a cross sectional view of the actuator of FIG. 1 in the extended position.
Figure 7:
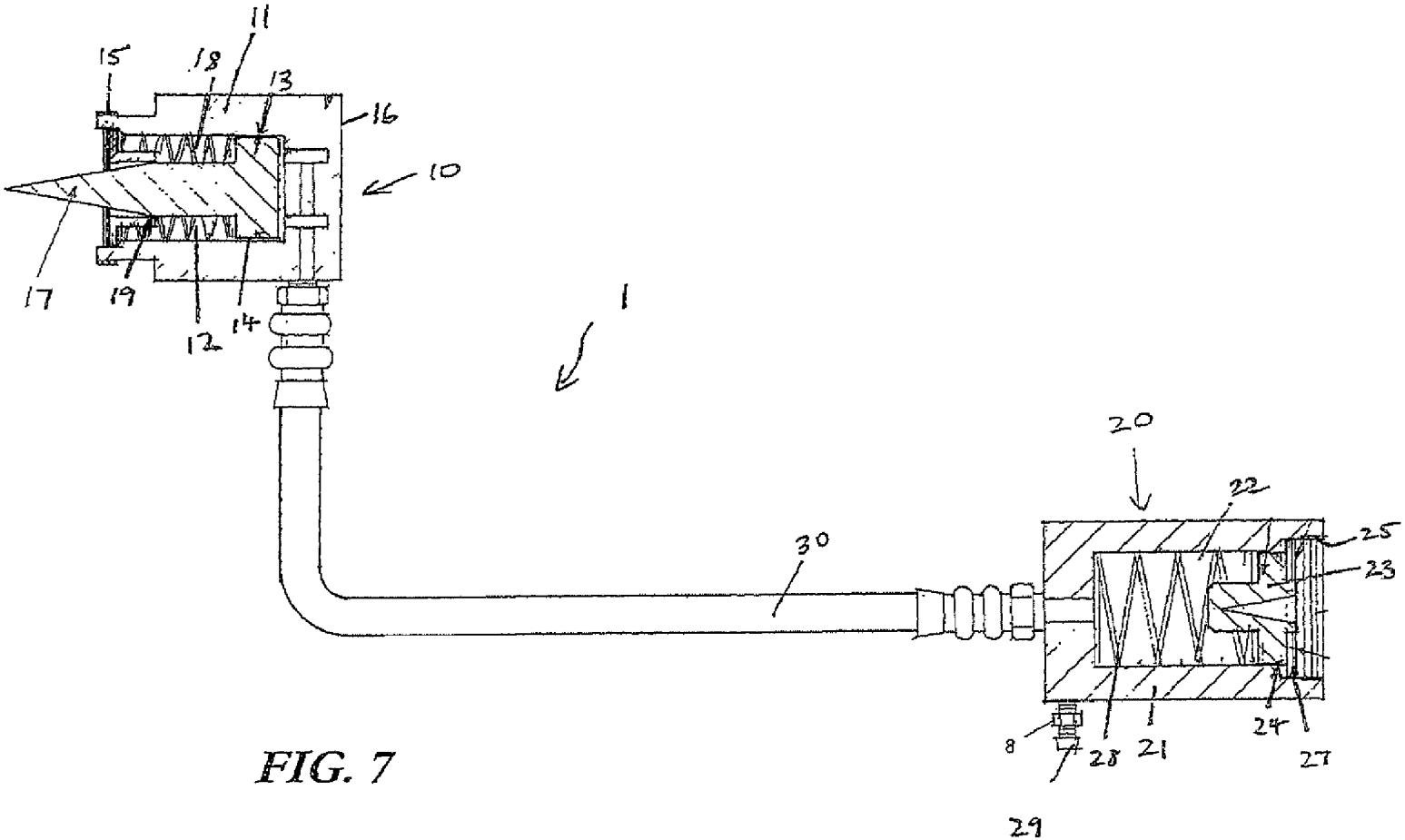
FIG. 7 is a cross sectional view of an extension for a pipe expander according to one embodiment of the invention.

The piston 13 is moveable within the housing 11 between a retracted position, as best shown in FIG. 7, in which the piston is positioned toward the rear of the chamber 12 and the shuttle pin 17 extends only partially from the opening 19 in the housing 11 and an extended position, as best shown in FIG. 5, in which the shuttle pin 17 extends further from the opening 19 in the housing 11. An intermediate position is shown in FIG. 3. Piston 13 includes a shuttle pin 17. The piston is biased into its retracted position by return spring 18 which is positioned in internal chamber 12.

First actuator 10 is arranged to receive a pipe expander head at threaded portion 15. First actuator 10 further includes a service end cap 16 which is positioned at the end of chamber 12 distal from shuttle pin 17 and is removable to allow for servicing and assembly.

Shuttle pin O-ring 19 provides a seal about shuttle pin 17 to seal chamber 12.

The second actuator 20 comprises a housing 21 which defines an internal chamber 22. A piston 23 is positioned within internal chamber 22 and is moveable within internal chamber 22 with respect to the housing 21. The piston 23 is sealed within internal chamber 22 by O rings 24. Thus internal chamber 22 is closed at one end by the piston 23 and O-rings 24.

Second actuator 20 is arranged to operatively engage with and receive a pipe expander (not illustrated) at threaded portion 25. The pipe expander attaches with second actuator 20 and acts upon piston 23 to initiate movement of piston 23 within chamber 22.

Figure 6:
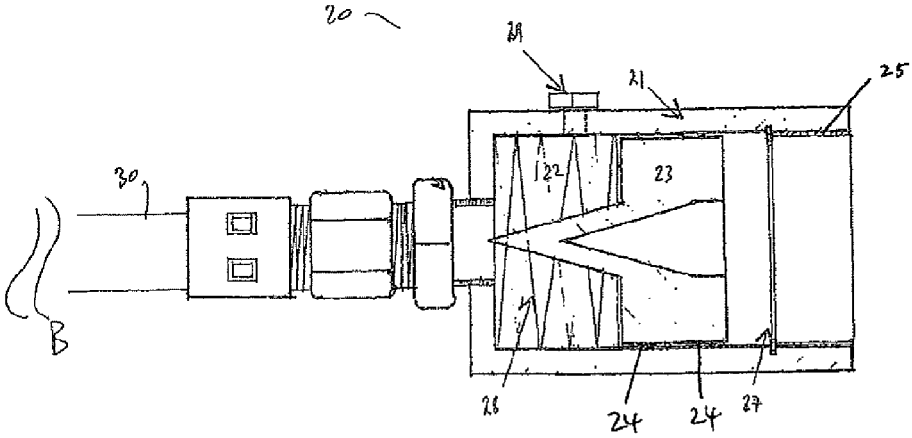
FIG. 6 is a cross sectional view of the actuator of FIG. 2 in the extended position

Piston 23 is moveable between an actuated position, shown in FIG. 6, in which the piston 23 is positioned away from clip 27 and a retracted position as shown in FIG. 7, in which the piston rests against clip 27. The piston 23 is biased into the retracted position by return spring 28 and operates against return spring 28. Clip 27 retains piston 23 inside housing 21 while allowing piston 23 to be contacted from external to the second actuator 20.

The assembly 1 further includes hydraulic hose 30 which is in fluid communication with both chamber 12 and chamber 22. As a result chambers 12 and 22 are in fluid connection with one another. Hydraulic fluid fills both chambers 12 and 11 and the hose 30. Hydraulic fluid may be introduced at refill plug 29. Hydraulic hose 30 can be made any suitable length, though hose lengths of 0.2 m to 0.5 m are particularly suitable.

It can be seen that movement of piston 23 within chamber 22 effects a pressure change in the hydraulic fluid within chamber 22. This, in turn, is transferred to effect a pressure change on the hydraulic fluid in chamber 12 and thus to initiate movement of piston 12.

The assembly 1 comprising first actuator 10 and second actuator 20 connected by hydraulic hose 30 is used in conjunction with a pipe expander (not illustrated). Second actuator 20 is fitted to a pipe expander by screwing actuator 20 onto the pipe expander at threaded portion 25. Second actuator 20 is designed such that the pipe expander acts on piston 23.

An appropriate expander head (not shown) to suit the particular diameter of pipe (not shown) to be expanded is engaged with threaded portion 15 of first actuator 10.

When the pipe expander is actuated (for example, by squeezing its handles together), the mechanism of the pipe expander bears against and effects movement of piston 23. This in turn causes pressure to increase in chamber 22 which causes flow of hydraulic fluid through hydraulic hose 30 into chamber 12 to effect a corresponding increase of pressure in chamber 12 and a resultant movement of piston 13 into its extended position. Piston 13 in turn moves shuttle pin 17 which causes actuation of the expander head in the usual manner to deform the end of a pipe to expand the pipe.

Figure 4:
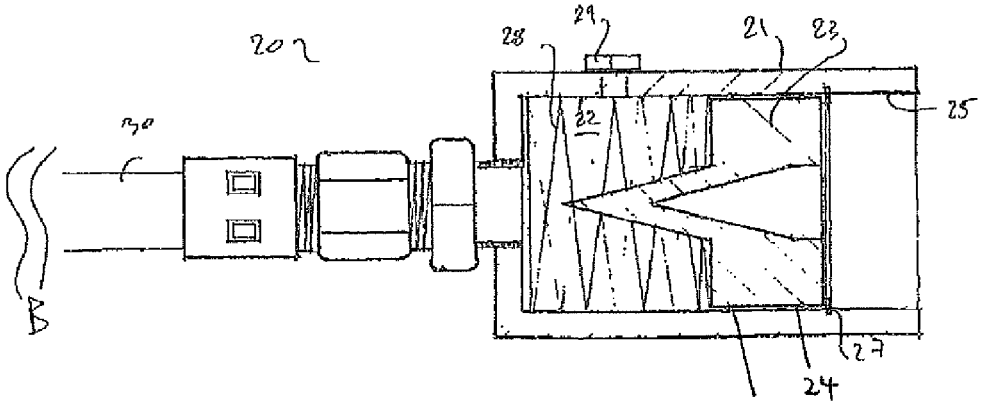
FIG. 4 is a cross sectional view of the actuator of FIG. 2 in an intermediate position.

When the handles of the pipe expander are released, the mechanism of the pipe expander retracts. Return springs 18 and 28 then expand to move pistons 13 and 23 back to their retracted positions as shown in FIGS. 3 and 4.

Use of the assembly 1 allows first actuator 10 to be brought against the end of a pipe to be expanded when the pipe end is in a position that would otherwise be inaccessible by use of a pipe expander alone, such as a position close to an internal corner, or buried in concrete. The first actuator is then actuated from a distance through hydraulic hose 30. Use of the extension avoids the need, or reduces the need, to make or enlarge holes in floors or walls to gain access to expand a pipe end. The extension thus saves time and effort to effect plumbing repairs and installations.

It is to be appreciated that various alterations or additions may be made to the parts previously described without departing from the spirit or ambit of the present invention. While the assembly has been described with respect to a hydraulic actuation, persons skilled in the art would recognise that actuation by electrical or mechanical means would fall within the scope of the claims. The hydraulic hose could be replaced by an electrical conduit while each piston and cylinder could be replaced by mechanically or electrically actuated shuttle pins moving with respect to a housing.

Any reference to prior art contained herein is not to be taken as an admission that the information is common general knowledge, unless otherwise indicated.

We claim:

1. An assembly for actuating a pipe expander, the assembly comprising:

a first actuator selectively engaging a pipe expander head and selectively actuating the pipe expander head; and a second actuator, spaced apart from the first actuator and operatively engaged with said first actuator, such that operation of the second actuator effects operation of the first actuator to actuate the pipe expander head, the first actuator having a first piston located within a first cylinder, a movement of the first piston with respect to the first cylinder actuating the pipe expander head, and the second actuator having a second piston located within a second cylinder, wherein the first actuator and second actuator are operatively engaged such that movement of the second piston with respect to the second cylinder effects movement of the first piston with respect to the first cylinder; wherein the second actuator operatively engages the pipe expander and actuation of the pipe expander causes movement of the second piston with respect to the second cylinder.

2. An assembly for actuating a pipe expander as defined in claim 1, wherein the first actuator and second actuator are connected by a conduit.

3. An assembly for actuating a pipe expander as defined in claim 1, wherein the first actuator and second actuator are connected by a fluid tight conduit.

4. An extension for a pipe expander as defined in claim 3, wherein the fluid tight conduit is flexible.

5. An extension for a pipe expander as defined in claim 3, wherein the fluid tight conduit is a hydraulic hose.

6. An assembly for actuating a pipe expander as defined claim 3, wherein the fluid tight conduit contains hydraulic fluid and is in fluid communication with the first and second actuators.

7. An extension for a pipe expander as defined claim 1, wherein the first actuator includes a helical thread to receive the pipe expander head.

8. An extension for a pipe expander as defined in claim 1, wherein the first piston is moveable between a retracted position in which it is contained in the first cylinder and an extended position in which it extends beyond the first cylinder.

9. An extension for a pipe expander as defined in claim 8, wherein the first piston actuates the pipe expander head when in the extended position.

10. An extension for a pipe expander as defined in claim 1, wherein the first actuator and second actuator each include a chamber, the chambers being in fluid communication.

11. An extension for a pipe expander, the extension including:

a first end selectively to receiving a pipe expander head, the first end including a first chamber and piston;

a second end arranged to fit to the pipe expander, the second end including a second chamber and piston; and a fluid tight conduit which joins the first and second chambers.

12. An extension according to claim 11, wherein the fluid tight conduit is flexible.

13. A method of using a pipe expander comprising:

engaging a pipe expander head with a first piston and cylinder assembly such that movement of the first piston with respect to the first cylinder actuates the pipe expander head; and initiating movement of the first piston with respect to the first cylinder by initiating movement of a second piston with respect to a second cylinder, the second piston and second cylinder being part of a second piston and cylinder assembly which is in fluid communication with the first piston and cylinder assembly;

initiating movement of the second piston with respect to the second cylinder comprises;

engaging the second piston and cylinder assembly with the pipe expander such that actuation of the pipe expander causes movement of the second piston with respect to the second cylinder; and actuating the pipe expander.

* * * * *